US008408908B1

(12) United States Patent
Preston et al.

(10) Patent No.: US 8,408,908 B1
(45) Date of Patent: Apr. 2, 2013

(54) NON-PYROTECHNIC DETONATION SIMULATOR

(75) Inventors: Steven Gordon Preston, Winter Springs, FL (US); Thomas Hans Penner, Apopka, FL (US); Charles Thomas Penrose, Oakland, FL (US); James A. Frey, Ocoee, FL (US)

(73) Assignee: Lockheed Martin Corporation, Orlando, FL (US)

( * ) Notice: Subject to any disclaimer, the term of this patent is extended or adjusted under 35 U.S.C. 154(b) by 370 days.

(21) Appl. No.: 12/949,399

(22) Filed: Nov. 18, 2010

(51) Int. Cl.
*F41A 33/00* (2006.01)

(52) U.S. Cl. ..... 434/11

(58) Field of Classification Search ..... 434/11, 434/14, 15, 16, 171; 102/200, 202, 205, 102/206, 217, 224
See application file for complete search history.

(56) References Cited

U.S. PATENT DOCUMENTS 4,393,509 A * 7/1983 Merkel et al. ..... 376/156
5,090,321 A * 2/1992 Abouav ..... 102/200
5,326,268 A * 7/1994 Campagnuolo ..... 434/15
6,386,108 B1 * 5/2002 Brooks et al. ..... 102/217
6,732,656 B1 * 5/2004 Heyse et al. ..... 102/202.1
7,083,414 B2 * 8/2006 Sansolo ..... 434/11
7,220,927 B2 5/2007 Browne et al.
7,597,047 B2 * 10/2009 Doyle et al. ..... 102/355
2006/0162602 A1 * 7/2006 Garms et al. ..... 102/335
2006/0166171 A1 7/2006 Preston et al.
2007/0166667 A1 * 7/2007 Jones et al. ..... 434/11

OTHER PUBLICATIONS

Unknown, "Electrolytic capacitor," Wikipedia, the free encyclopedia, http://en.wikipedia.org/w/index.php?title=Electrolytic_capacitor&printable=yes, accessed Aug. 3, 2010, 1 page.
Unknown, "Tantalum capacitor," Wikipedia, the free encyclopedia, http://en.wikipedia.org/w/index.php?oldid=375763276, accessed Aug. 3, 2010, 5 pages.

* cited by examiner

*Primary Examiner* — Kurt Fernstrom
(74) *Attorney, Agent, or Firm* — Withrow & Terranova, PLLC

(57) ABSTRACT

Embodiments include a non-pyrotechnic detonation simulator. The simulator includes a substrate, a plurality of capacitors fixed with respect to the substrate, a voltage source, and a controller. The controller is electrically coupled to the capacitors and is adapted to selectively direct a burst voltage from the voltage source to one or more of the capacitors to cause the one or more of the plurality of capacitors to burst.

20 Claims, 5 Drawing Sheets

NON-PYROTECHNIC DETONATION SIMULATOR

FIELD OF THE DISCLOSURE

Embodiments herein relate to non-pyrotechnic detonation simulators, and in particular to detonation simulators that use capacitors to simulate the detonation of ammunition and other detonable munitions.

BACKGROUND

It is desirable that military combat training simulate actual combat conditions to the greatest extent possible. One important aspect of military training relates to the firing of weapons. While bullets or blanks may sometimes be used in training exercises, sometimes the use of real ammunition is not appropriate in a particular training activity, and the use of blanks can be quite costly. Other pyrotechnics that simulate the detonation of munitions may be dangerous and may require that the participants wear protective clothing, diminishing the realism of the simulation. Accordingly, non-pyrotechnic detonation simulators that simulate the sound of gunfire and the detonation of other munitions are desirable.

SUMMARY

Embodiments disclosed herein relate to detonation simulators that realistically simulate the detonation of munitions. In one embodiment, a detonation simulator includes a substrate and a plurality of capacitors fixed with respect to the substrate. A voltage source is electrically coupled to the capacitors and to a controller that can selectively direct a burst voltage to one or more of the capacitors to cause the one or more capacitors to burst. The controller may selectively direct the burst voltage to the one or more capacitors in response to activation of a trigger, for example.

The substrate and the capacitors may be positioned in an interior volume of a housing. As the capacitors burst inside the housing, the housing prevents capacitor particles from impacting a human. The energy released by the burst is transferred to the housing, which vibrates, resulting in a sound that simulates the detonation of munitions.

In one embodiment, the capacitors are either solid state or electrolytic tantalum capacitors (sometimes referred to as "wet slugs"). The controller may be adapted to selectively direct a burst voltage sequentially to a series of the capacitors in response to activation of a trigger.

In one embodiment related to the simulated detonation of assault rifle ammunition, the housing may have a shape substantially similar to a magazine of an assault rifle, and be adapted to couple with a magazine well of an assault rifle. The housing may include a trigger interface connector that is electrically coupled to the controller. The trigger interface connector receives a trigger signal that indicates the activation of the trigger of the assault rifle and passes the signal to the controller. In response, the controller may then selectively direct a burst voltage sequentially to a series of the capacitors. After each of the plurality of capacitors has burst, the housing may be easily ejected from the magazine well and another housing with fresh capacitors may be installed into the magazine well.

In another embodiment, which is related to the simulated detonation of machine gun ammunition, the substrate may comprise an elongated belt. A plurality of the capacitors is fixed with respect to the belt sequentially along a length of the belt a relatively uniform distance from one another. The elongated belt includes a plurality of capacitor contacts, each of which is conductively coupled to a respective capacitor of the plurality of capacitors. A belt advance mechanism is adapted to engage the belt and selectively advance the belt with respect to a voltage source lead to sequentially electrically couple each of the plurality of contacts with the voltage source lead. The controller may be adapted to selectively direct the burst voltage to the capacitors as each corresponding capacitor contact is electrically coupled to the voltage source lead. A housing having a belt receiver opening for receiving the belt and a belt discharge opening for discharging the belt may enclose the voltage source lead such that the capacitors are within the housing when the burst voltage is applied.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed herein relate to non-pyrotechnic detonation simulators for simulating the detonation of munitions including, but not limited to, assault rifle ammunition, machine gun ammunition, bombs, and other munitions. Embodiments herein do not require speaker systems, which eliminates a need for the space required to allow a speaker to move large volumes of air. By using relatively commodity electronic components, such as solid state or electrolytic capacitors, the detonation simulator may be relatively inexpensively manufactured.

Figure 1:
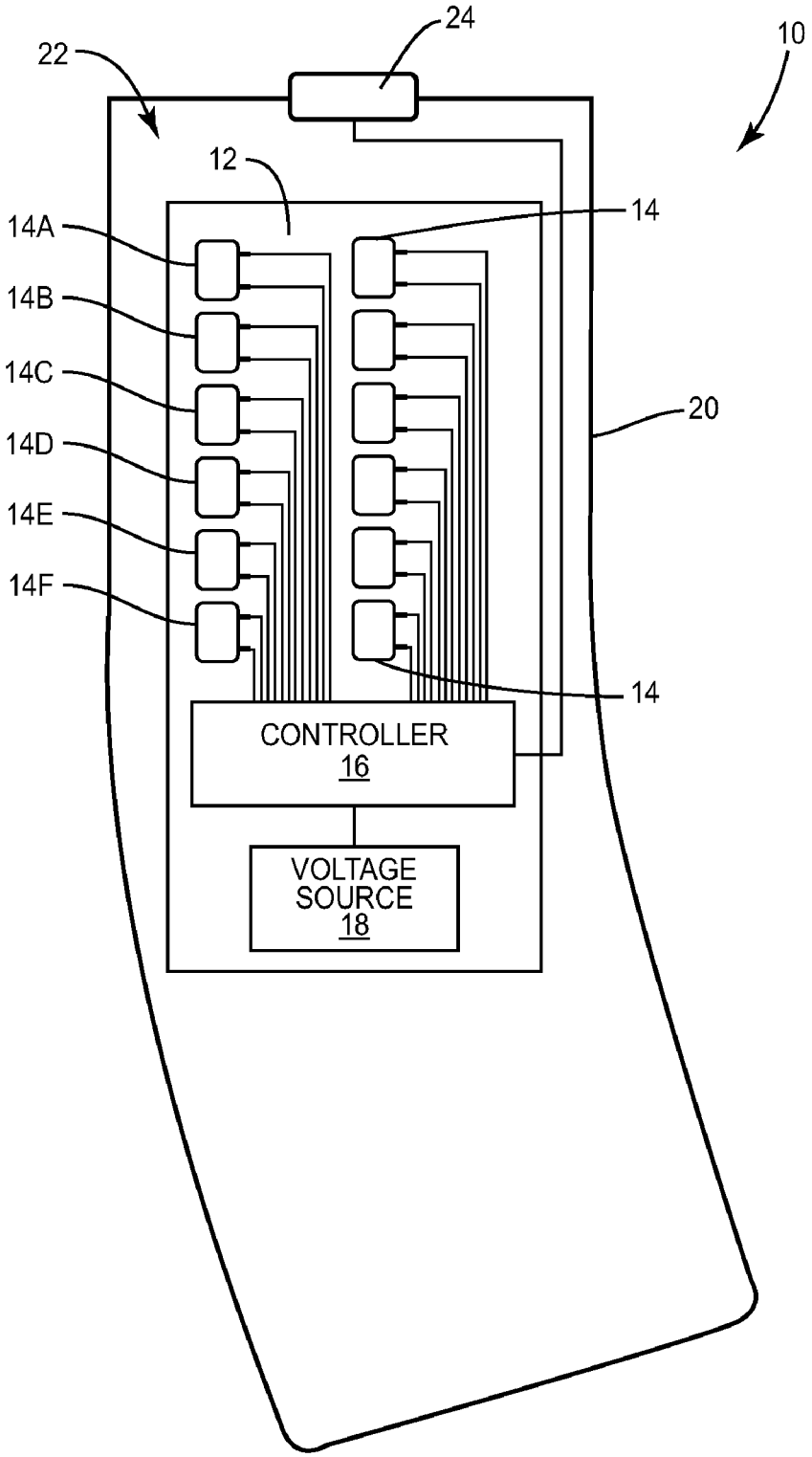
FIG. 1 is a diagram of an exemplary detonation simulator according to one embodiment.

FIG. 1 is a block diagram of a detonation simulator 10 according to one embodiment. The detonation simulator 10 includes a substrate 12. The substrate 12 may comprise any suitable material, such as a printed circuit board (PCB), to which a plurality of capacitors 14A-14L (generally, capacitor 14 or capacitors 14) may be fixed. The capacitors 14 may be fixed with respect to the substrate 12 in any suitable manner, such as, for example, soldering or the like. The capacitors 14 may comprise any capacitor that, upon application of an appropriate voltage, will burst or otherwise explode.

In one embodiment, the capacitors 14 comprise either solid state or electrolytic tantalum capacitors. Tantalum capacitors are sensitive to forward voltages in excess of a rated voltage of the capacitor, and a forward voltage in excess of the rated voltage will typically cause a tantalum capacitor to burst. Tantalum capacitors are also sensitive to a reverse voltage, and applying a reverse voltage to a tantalum capacitor will also typically cause the tantalum capacitor to burst. As used herein, the phrase "burst voltage" refers to either a forward voltage in excess of the rated voltage of the capacitor 14, or a reverse voltage sufficient to cause the capacitor 14 to burst. While for purposes of illustration twelve capacitors 14 are shown, any number of capacitors 14 may be used.

The capacitors 14 are electrically coupled to a sequencer, such as a controller 16. The controller 16 is coupled to a voltage source 18, and selectively directs a burst voltage to the capacitors 14 to cause the capacitors to burst. The controller 16 comprises circuitry adapted to apply the burst voltage selectively in response to a signal, such as the activation of a trigger, as discussed in greater detail below. The voltage source 18 may comprise, for example, a battery, such as a lithium battery. In one embodiment, the voltage source 18 may comprise a lithium battery and buck-boost converter circuitry adapted to boost the voltage of, for example, a 3 volt to 5 volt lithium battery to a voltage suitable for bursting the capacitors, such as 15 volts to 30 volts. While for purposes of illustration the leads of the capacitors 14 are shown terminating at the controller 16, other architectures would be suitable, such as terminating one lead of each capacitor 14 at the controller 16 and the other lead at the voltage source 18.

The substrate 12, the capacitors 14, the controller 16, and the voltage source 18 may be positioned in a housing 20 having an interior volume 22. The housing 20 prevents injury that may otherwise be caused by pieces of the capacitors 14 that may be ejected when the capacitors 14 burst. The housing 20 also vibrates due to the energy released when the capacitors 14 burst, and thereby produces a sound of simulated gunfire. The housing 20 may comprise any suitably rigid material, such as metal or injection molded plastic.

The housing 20 may include a trigger interface connector 24 that is electrically coupled to the controller 16, and via which the controller 16 may be coupled to a trigger (not illustrated). Upon receipt of a signal indicating activation of a trigger (e.g., when a participant pulls a trigger of a simulated assault rifle), the controller 16 may be adapted to selectively direct a burst voltage to a series of the capacitors 14. In one embodiment, the controller 16 may be adapted to operate in an automatic firing mode, wherein for as long as the trigger is activated, the controller 16 sequentially applies the burst voltage to a series of the capacitors 14. For example, if the participant presses the trigger and keeps the trigger pressed for a time frame sufficient to cause the rifle to fire four rounds, the controller may direct the burst voltage to a series of four capacitors 14, such as the capacitors 14A, 14B, 14C, 14D, to cause each capacitor 14A-14D to sequentially burst, simulating the detonation of assault rifle rounds when firing an assault rifle in automatic firing mode.

The controller 16 may also be adapted to operate in a semi-automatic firing mode wherein each activation of the trigger causes the controller 16 to direct a burst voltage to a different capacitor 14 in response to each activation of the trigger. For example, a participant may press the trigger three times, and in response to the first press, the controller 16 may direct a burst voltage to the capacitor 14A, in response to the second press, the controller 16 may direct a burst voltage to the capacitor 14B, and in response to the third press, the controller 16 may direct a burst voltage to the capacitor 14C. The controller 16 may be programmed to operate in either automatic firing mode or semi-automatic firing mode, or may be selectively placed in either mode in response to a signal generated in response to a participant's selection of a desired firing mode.

Figure 2:
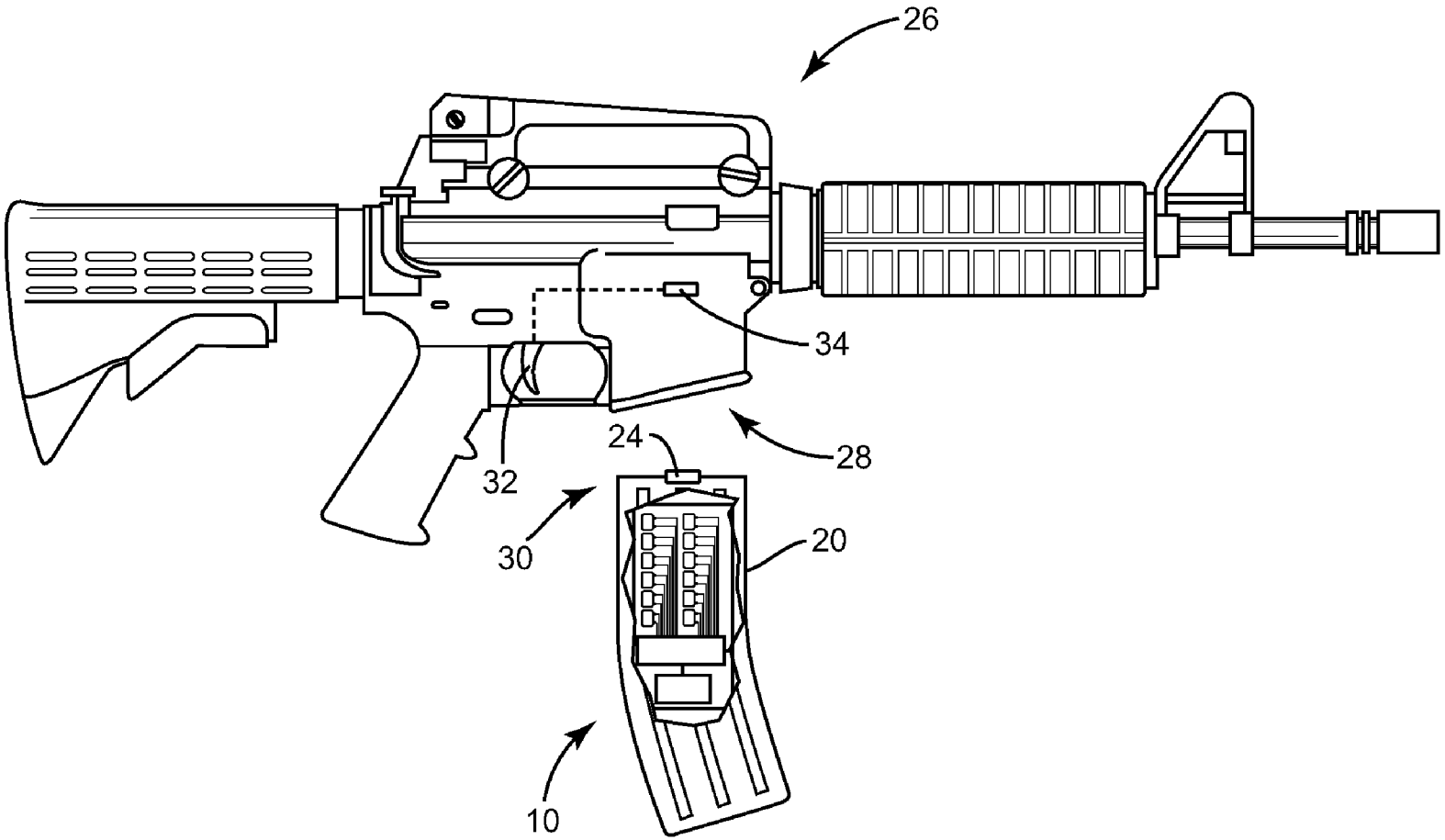
FIG. 2 is a diagram of the detonation simulator illustrated in FIG. 1 used in conjunction with a simulated assault rifle.

FIG. 2 is a diagram of the detonation simulator 10 illustrated in FIG. 1 used in conjunction with a simulated assault rifle 26. The assault rifle 26 includes a magazine well 28 that is capable of receiving an end portion 30 of the detonation simulator 10. The assault rifle 26 includes a trigger 32 that is coupled to a trigger interface connector 34. The trigger interface connector 34 preferably extends into the magazine well 28 and is adapted to couple with the trigger interface connector 24 on the housing 20 when the detonation simulator 10 is properly inserted into the magazine well 28. Once the trigger interface connector 34 (which, for example, may be a male connector) is coupled with the trigger interface connector 24 (which, for example, may be a female connector), the controller 16 is coupled to the trigger 32. Pressing, or otherwise activating the trigger 32 sends a signal to the controller 16, and the controller 16 can selectively direct a burst voltage to the capacitors 14 in response to the signal. The bursting capacitors 14 release energy which causes the housing 20 to vibrate, resulting in a tactile sensation and a sound that simulates gunfire. The housing 20 retains any particles of the capacitors 14 that may be generated due to the bursting of the capacitors 14. Once all the capacitors 14 on the substrate 12 have burst, the participant may eject the detonation simulator 10 from the magazine well 28, and a second detonation simulator 10 (not illustrated) may be inserted into the magazine well 28, similar to the way ammunition is reloaded under actual combat conditions.

Figures 3, 4:
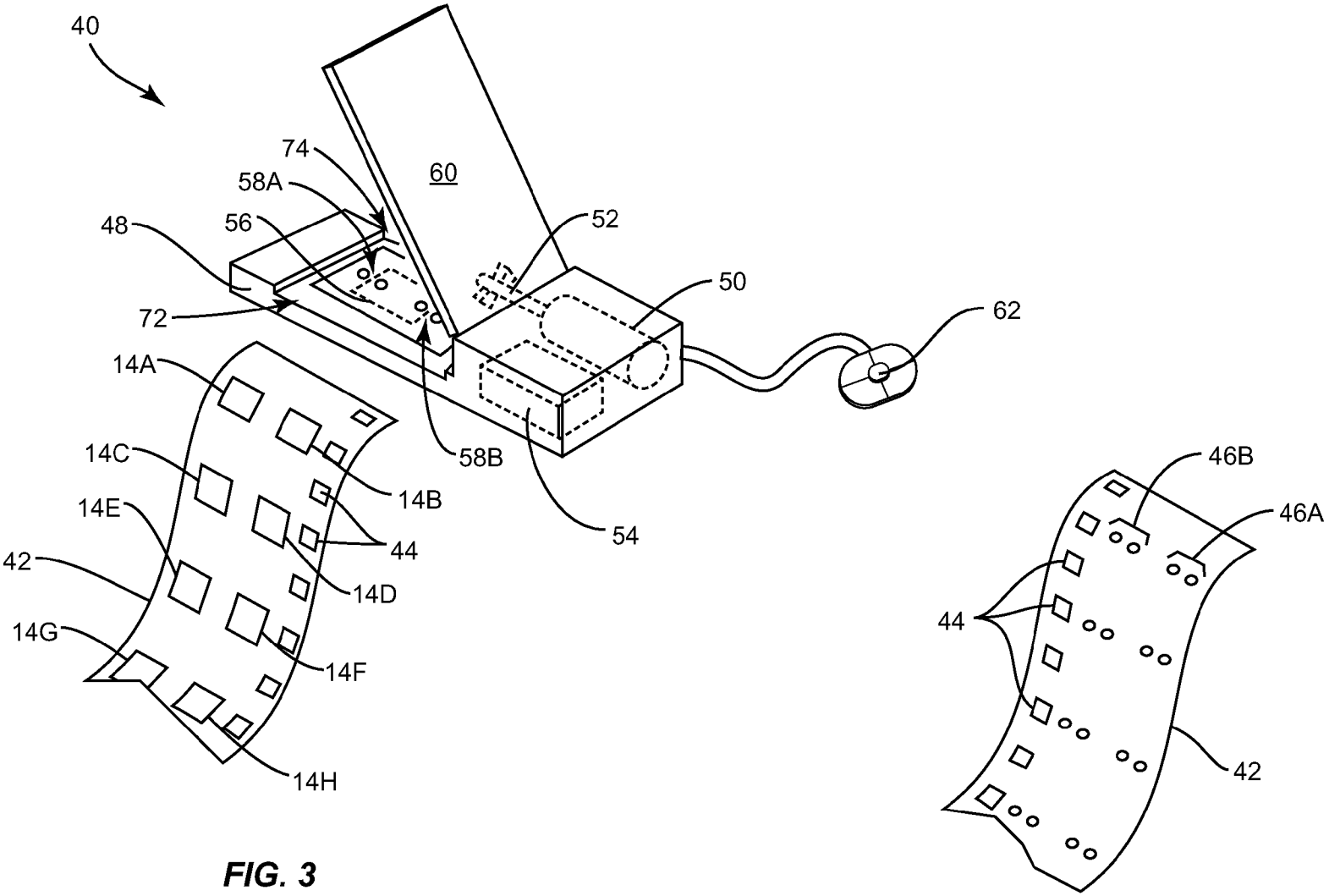
FIG. 3 is a diagram of an exemplary detonation simulator according to another embodiment relating to the simulation of machine gunfire.
FIG. 4 is a diagram illustrating a bottom side of the substrate illustrated in FIG. 3.

FIG. 3 is a diagram of an exemplary detonation simulator 40 according to another embodiment relating to the simulation of machine gunfire, where the detonation simulator 40 is in a shape of a simulated machine gun ammunition receiver. The detonation simulator 40 includes a substrate 42 which comprises a flexible elongated belt. FIG. 3 illustrates a top side of the substrate 42. A plurality of capacitors 14 are fixed with respect to the substrate 42. Some of the capacitors 14, such as the capacitors 14A, 14C, 14E, and 14G, form a column of capacitors 14 that are fixed with respect to the substrate 42 sequentially along a length of the substrate 42 a relatively uniform distance from one another. Similarly, the capacitors 14B, 14D, 14F, and 14H form a second column of capacitors 14 that are fixed with respect to the substrate 42 sequentially along a length of the substrate 42 a relatively uniform distance from one another. While for purposes of illustration the substrate 42 is illustrated with eight capacitors 14, it should be apparent that the substrate 42 may have hundreds, or thousands, of capacitors 14, depending on the length of the substrate 42. The substrate 42 may also include a plurality of engagement indentations, or engagement notches 44, along the length of the substrate 42 to aid in selectively advancing the substrate 42 as discussed below.

Referring briefly to FIG. 4, a bottom side of the substrate 42 illustrated in FIG. 3 is illustrated. The substrate 42 may include a plurality of capacitor contact pairs 46, each of which is electrically coupled to a lead of a respective capacitor 14. For example, each contact of the capacitor contact pair 46A is coupled to a lead of the capacitor 14A. Similarly, each contact of the capacitor contact pair 46B is coupled to a lead of the capacitor 14B.

Returning to FIG. 3, the detonation simulator 40 includes a housing 48. The housing 48 may be formed, for example, out of metal, or a suitably rigid injection molded plastic. The housing 48 houses a belt advance assembly that comprises a drive motor 50 which selectively rotates a drive shaft 52. The drive shaft 52 engages the engagement notches 44 to selectively advance the substrate 42 through the housing 48. The drive motor 50 and the drive shaft 52 are but one exemplary belt advance assembly suitable for embodiments herein, and any other suitable belt advance assembly may be used.

The housing 48 may also include a voltage source 54 for providing electric current to the drive motor 50. The housing 48 includes a controller 56 that selectively provides a burst voltage to one or more capacitors 14 via voltage source leads 58A, 58B (generally, voltage source lead 58 or voltage source leads 58). At least one of the voltage source leads 58A and one of the voltage source leads 58B are electrically coupled to a voltage source, such as the voltage source 54. The housing 48 includes a plate 60 which has an open and closed position, and in the closed position preferably provides tension to the substrate 42 as the substrate 42 advances through the housing 48.

The controller 56 is electrically coupled to a trigger 62 and may control the drive motor 50 in response to activation of the trigger 62. In operation, a participant feeds an end portion of the substrate 42 into the housing 48 such that the drive shaft 52 engages the substrate 42. The plate 60 is either already in a closed position, or is thereafter urged into the closed position. Pressing, or otherwise activating, the trigger 62 causes a signal to be sent to the controller 56. The controller 56 activates the drive motor 50 to cause the substrate 42 to advance through the housing 48. The controller 56 also selectively directs a burst voltage to the voltage source leads 58 as the voltage source leads 58 come into electrical contact with corresponding capacitor contact pairs 46. As the capacitors 14 burst within the housing 48, the housing 48 vibrates, causing a tactile sensation and a sound that simulates machine gunfire. The housing 48 also inhibits any pieces of the capacitors 14 from exiting the housing 48 as the capacitors 14 burst.

Figure 5:
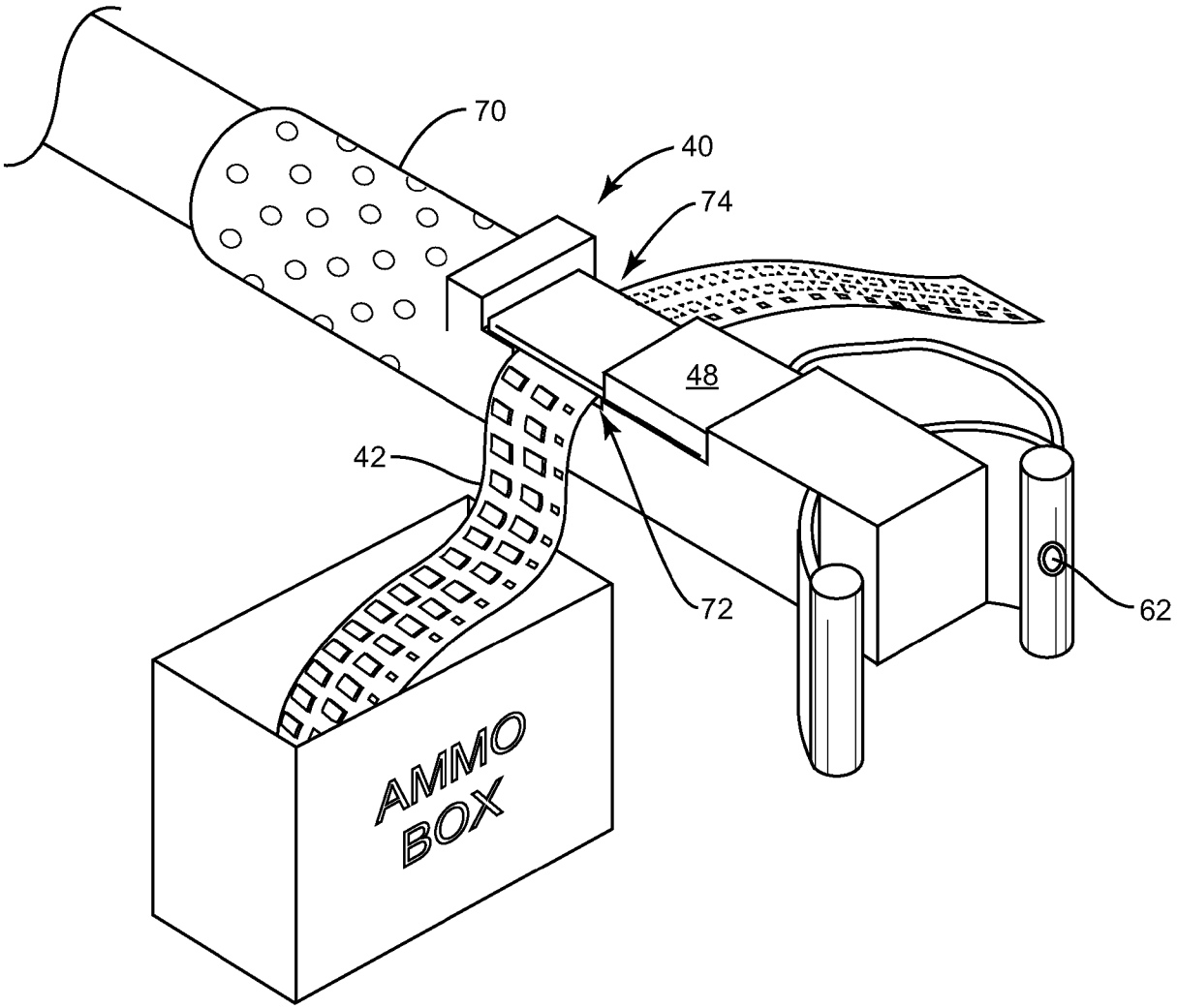
FIG. 5 is a diagram of the detonation simulator illustrated in FIG. 3 coupled to a simulated machine gun.

FIG. 5 is a diagram of the detonation simulator 40 coupled to a simulated machine gun 70. The substrate 42 is fed into a belt receiver opening 72 of the housing 48. Upon activation of the trigger 62, the controller 56 activates the drive motor 50, and the drive shaft 52 engages the substrate 42. For as long as the trigger 62 is pressed, the drive shaft 52 rotates, pulling the substrate 42 through the housing 48 and discharging the substrate 42 via a belt discharge opening 74. As the capacitor contact pairs 46 contact the voltage source leads 58, the controller 56 directs a burst voltage to the voltage source lead(s) 58 to cause the corresponding capacitor(s) 14 to burst. Alternately, the controller 56 continuously maintains the burst voltage at the voltage source leads 58 while the trigger 62 is pressed.

Figure 6:
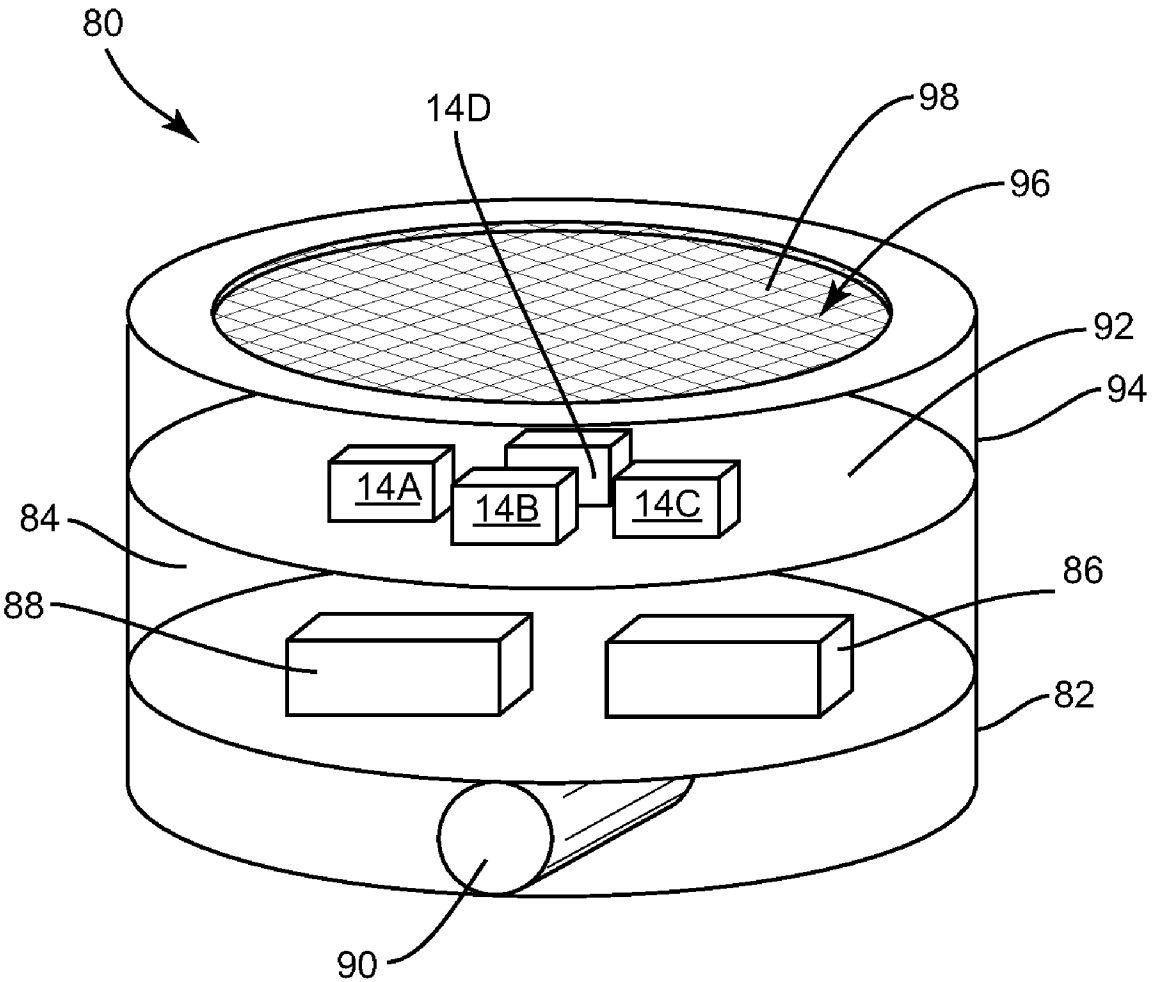
FIG. 6 is a diagram of an exemplary detonation simulator according to another embodiment relating to the simulation of a bomb.

FIG. 6 is a diagram of an exemplary detonation simulator 80 according to another embodiment relating to the simulation of a bomb. The detonation simulator 80 includes a housing 82 having an interior volume 84, in which a controller 86 and buck-boost converter circuitry 88 are positioned. The detonation simulator 80 may also include a system battery 90, such as a lithium battery.

The detonation simulator 80 includes a substrate 92 to which a plurality of capacitors 14A-14D are fixed. The capacitors 14 are electrically coupled to the controller 86 and/or the buck-boost converter circuitry 88. The substrate 92 may be in the form of an enclosed replaceable housing 94, such that after detonation of the detonation simulator 80, the housing 94 may be replaced with another housing 94 containing undetonated capacitors 14. The housing 94 may include, for example, an interface connector (not shown) that couples to another interface connector (not shown) in the housing 94 to establish a conductive path between the controller 86 and the capacitors 14.

The detonation simulator 80 may also include a powder reservoir 96 that contains a powder that is ejected through a screen 98 upon activation of a small motor (not shown) to simulate smoke associated with the detonation of a bomb.

In operation, the controller 86 receives a detonation signal and directs a burst voltage from the voltage source 88 to the capacitors 14. The detonation signal may be provided in any desirable manner, including, for example, by a motion sensor, an infrared signal, a direct-wired trigger, or the like. The controller 86 may apply a burst voltage concurrently to each of the capacitors 14 to cause the capacitors 14 to burst substantially simultaneously, or may direct a burst voltage to each of the capacitors 14 in rapid succession.

Those skilled in the art will recognize improvements and modifications to the preferred embodiments of the present disclosure. All such improvements and modifications are considered within the scope of the concepts disclosed herein and the claims that follow.

What is claimed is:

1. A detonation simulator, comprising:

a substrate;

a plurality of capacitors fixed with respect to the substrate;

a voltage source; and a controller electrically coupled to the plurality of capacitors and adapted to selectively direct a burst voltage from the voltage source to one or more of the plurality of capacitors to cause the one or more of the plurality of capacitors to burst.

2. The detonation simulator of claim 1, wherein the plurality of capacitors comprises one of solid state tantalum capacitors and electrolytic tantalum capacitors.

3. The detonation simulator of claim 1, wherein the burst voltage comprises a voltage in excess of a voltage rating for the one or more of the plurality of capacitors.

4. The detonation simulator of claim 1, wherein the burst voltage comprises a reverse voltage with respect to a rated forward voltage of the one or more of the plurality of capacitors.

5. The detonation simulator of claim 1, wherein the substrate comprises an elongated belt, and wherein at least some of the plurality of capacitors are fixed with respect to the belt sequentially along a length of the belt a uniform distance from one another.

6. The detonation simulator of claim 5, wherein the elongated belt further comprises a plurality of capacitor contact pairs, wherein each of the plurality of capacitor contact pairs is conductively coupled to a respective capacitor of the plurality of capacitors.

7. The detonation simulator of claim 6, further comprising a belt advance assembly adapted to engage the elongated belt and selectively advance the elongated belt with respect to a voltage source lead to sequentially electrically couple each of the plurality of capacitor contact pairs with the voltage source lead.

8. The detonation simulator of claim 7, wherein the controller is adapted to selectively direct the burst voltage to the one or more of the plurality of capacitors as a corresponding capacitor contact pair is electrically coupled to the voltage source lead.

9. The detonation simulator of claim 8, further comprising a housing having a belt receiver opening for receiving the elongated belt and a belt discharge opening for discharging the elongated belt, the housing enclosing the voltage source lead such that the plurality of capacitors is within the housing when the burst voltage is applied.

10. The detonation simulator of claim 9, wherein the housing comprises a simulated machine gun ammunition receiver.

11. The detonation simulator of claim 7, wherein the belt advance assembly further comprises a trigger, and wherein activation of the trigger causes the belt advance assembly to selectively advance the elongated belt.

12. The detonation simulator of claim 1, further comprising:

a housing having an interior volume in which the substrate, the plurality of capacitors, the voltage source, and the controller are positioned.

13. The detonation simulator of claim 12, wherein the housing comprises one of a simulated assault rifle magazine and a simulated bomb.

14. The detonation simulator of claim 12, wherein the controller is further adapted to selectively direct the burst voltage sequentially to a series of the plurality of capacitors.

15. The detonation simulator of claim 14, further comprising:

a trigger coupled to the controller, wherein the controller is adapted to selectively direct the burst voltage sequentially to the series in response to an activation of the trigger.

16. The detonation simulator of claim 14, wherein the controller is adapted to selectively direct the burst voltage sequentially to the series for as long as the trigger is activated.

17. The detonation simulator of claim 14, wherein the controller is adapted to selectively apply the burst voltage sequentially to the series such that the burst voltage is applied to a different capacitor in the series each time the trigger is activated.

18. The detonation simulator of claim 12, wherein the controller is further adapted to apply the burst voltage concurrently to the plurality of capacitors.

19. The detonation simulator of claim 1, wherein a bursting of the one or more of the plurality of capacitors simulates a sound of gunfire.

20. A detonation simulator, comprising:

a housing having an interior volume;

a substrate positioned in the housing, the substrate comprising a plurality of capacitors;

a voltage source positioned in the housing; and a controller, each of the capacitors electrically coupled to the controller and not electrically coupled to any other capacitor, and the controller adapted to selectively direct a burst voltage from the voltage source to one or more of the plurality of capacitors to cause the one or more of the plurality of capacitors to burst.

* * * * *